US009463663B1

(12) United States Patent
Martella

(10) Patent No.: US 9,463,663 B1
(45) Date of Patent: Oct. 11, 2016

(54) HARDBOARD MEDIUM FOR ART USING WOOD FROM A WINE BARREL

(71) Applicant: Monte Clinton Martella, Livermore, CA (US)

(72) Inventor: Monte Clinton Martella, Livermore, CA (US)

( * ) Notice: Subject to any disclaimer, the term of this patent is extended or adjusted under 35 U.S.C. 154(b) by 66 days.

(21) Appl. No.: 14/677,985

(22) Filed: Apr. 3, 2015

Related U.S. Application Data

(60) Provisional application No. 61/987,949, filed on May 2, 2014.

(51) Int. Cl.
*B44D 3/18* (2006.01)

(52) U.S. Cl.
CPC ..... *B44D 3/18* (2013.01)

(58) Field of Classification Search
CPC ..... B44D 3/18
USPC ..... 428/54
See application file for complete search history.

(56) References Cited

U.S. PATENT DOCUMENTS

2006/0121320 A1* 6/2006 Allen ..... B44D 3/18 428/319.7

* cited by examiner

*Primary Examiner* — Alexander Thomas
(74) *Attorney, Agent, or Firm* — Rouzbeh Alani; Leon E. Jew

(57) ABSTRACT

The current invention is a three dimensional medium for painting and artwork. Pieces of bowed wood, more commonly known as staves, are taken from an empty wine barrel. The staves can be of different types including French oak, white oak, or American white oak. Once the staves are extracted from the wine barrel, they are reused to create a medium back-drop for painting and artwork. Much like an artist that uses a canvas for the back drop of a painting, the constructed three-dimensional medium made is used as a back drop for a variety of artworks including paintings of custom flags, images, and portraits.

9 Claims, 6 Drawing Sheets

HARDBOARD MEDIUM FOR ART USING WOOD FROM A WINE BARREL

REFERENCE TO RELATED APPLICATION

The present application claims priority to the provisional Appl. Ser. No. 61/987,949 filed on May 2, 2014, the entire content of which is hereby incorporated by reference.

FIELD OF THE INVENTION

The present invention generally relates to the field of mediums for artwork. More particularly, the invention relates to painting on a specific type of hardboard medium extracted from a wine barrel to create various types of artwork including but not limited to flags of countries, portraits, and images of various styles.

BACKGROUND OF THE INVENTION

Painting dates back to the prehistoric era of cave dwellers around 20,000 B.C. In analyzing its history, the continents of Europe and Africa played a major role in the history of art. Some caves in these continents still contain many paintings that have been amazingly well preserved. They have been sealed up for a prodigious number of centuries, and to this day, colored drawings of animals and crude human figures can be found with a great attention to detail inside many of these caves. Additionally, people of prehistoric times have been noted for drawing pictures of nature and wildlife in some of these caves as well. In particular countries in Eastern Europe, cavers contain paintings with rich, bright colors using earth ochers and manganese elements as some of the tools used by the primitive people for painting their surroundings. These elements were applied to the walls of prehistoric caves with ancient brushes and helped to capture the beauty and serenity of nature around the primitive people from centuries ago.

With human evolution over the centuries, painting also evolved and new techniques with new materials were incorporated to create various styles of art. However, dating as far back as the prehistoric era, it is important to note that cave dwellers were the original people that invented the standard tools to create paintings. These tools form the basis of many of today's current painting methods and techniques.

Centuries after the prehistoric era, as painting continued to evolve, the Greek and Roman classical painting style came to light. Painters of this era created a unique style of encaustic paintings which were made on wood while melted beeswax was also used with paint to create portraits. Although this era was thousands of years ago, the portraits, especially of mummies and tombs, have lasted throughout time.

Furthermore, dating forward, to the $15^{th}$ century, the Renaissance era gave way to more enlightening artistic accomplishments particularly with revolutionary styles of painting. Several notable painters in the Renaissance era helped to advance painting especially by incorporating a three dimensional style complimenting the new progressive trend of the $15^{th}$ century. During this era, much of the paintings were performed on tightly stretched canvas as opposed to the previous methods of wood mediums. There was less concern with perspective patterns in painting, and more emphasis on decorative patterns. The famous artist Leonardo Da Vinci also came to light in this era. Although very few of his paintings have survived throughout time, one of his notable works is known as the Last Supper in which his distinguishing style of using oil paint can be exampled by modern painters today.

Influenced by the Renaissance era, other cultures in Europe in the following centuries began applying unique painting techniques. In Holland, the famous painter Rembrandt was gifted and talented in capturing human emotions. His paintings were particularly dark in tone and included many layers. In contrast, painters in Venice such as Giovanni Tiepolo painted with colorful frescoes on buildings to capture the past glories of the history of Venice.

In the 1800's the great center of the arts was established in the country of France, and during Napoleon's reign, two styles of paintings emerged: Classicism and Romanticism. These styles were influenced by previous eras and focused on ordinary subject matter. Painters worked out of studios and focused on methods and techniques for capturing the effects of light using the more accepted method of oil on canvas. This in turn influenced the later style of painters who are referred to as The Impressionists. To this day, Impressionism is widely accepted as the most effective style of painting which captured a scene of nature exactly as it was. Impressionist painters studied the effects of light in color to an extreme. A famous painting method used by two of the most famous Impressionists: Claude Monet and Pierre August Renoir was the small, even length brushstrokes. As an example of their style, when painting scenes of crowded people, the two painters exemplified images that appear to fade away in the sunlight with the unique use of their brushstrokes and color selections.

Influenced by previous centuries and accomplishments overseas, painters of the $20^{th}$ century particularly in the United States, began to show more enthusiasm in painting and artwork. Paintings of landscapes and portraits by American painters were based on European styles dating back to the $18^{th}$ century. In the 1900's Americans were following the European trends of painting with more intimate passion. A style of painting called: expressionism was popular in the United States and focused more on color, design, and rhythm. While in turn, painters were constantly looking for new ways to apply brushstrokes to various mediums. The idea was focused on creating originality and freedom by using bolder techniques to express a newer vision of art.

Today, painting is considered the romantic form of capturing the aforementioned eras of history. Many modern day painters continue to include old styles from prior centuries by using oil paint on wood as opposed to the popular canvas setting. By staying consistent with the three dimensional styles dating back to the Renaissance, painters have shown still yet a desire to use a flat wood or a stretched canvas back drop in certain cases. Although these techniques have been widely successful throughout history, we have seen fewer of the three-dimensional wood backdrops used by artists in more recent times. As noted above, before the Renaissance era, the more common medium for painting back drops was wood.

By taking facets of history prior to the Renaissance era and applying painting techniques to the ever changing styles of modern day expressionism, society can benefit from a three dimensional wood medium back drop to further enhance an image or portrait in a painting.

SUMMARY OF THE INVENTION

Oil paint is made by mixing pigments containing a color with oil, therefore, it is common for artists to paint by applying the oil to a canvas medium. Some of the advantages of oil on canvas paintings include: slower drying than watercolors, creating more luminous colors, blending well with surrounding paints, exposing the paint to air for several weeks without the concern of drying. Additionally, the paint can be left open for long periods of time. In contrast, other accepted mediums such as wood continue to be used but less often than canvas. Some of the advantages of wood which is more commonly known as hardboard include: a successful history of artistic achievements using oak wood, particularly in previous centuries of European Art including hardboard mediums used by artists in the Greek and Roman Classical Painting Era. Egyptian artists from this time also used wood native to the region to create artwork which still to this day has lasted with enduring quality. Furthermore, for artists who prefer a particular style of painting, wood can also be advantageous as the oils do not blend as easily as they may on canvas. Hardboard or wood can also be relatively inexpensive. In addition, a wood surface is more rigid and tends to have less cracking in the paintings.

In modern day households, particularly with the millenial generation, decorating a home with wooden artwork can exemplify a "turn back the clock" decorative style. In particular, sports teams which have gained popularity in modern societies; have continuously influenced economies around the world as well. Now, it is common for sports teams and logos to be used as art décor in households around the world. Team logos now can be displayed on wooden mediums by artists. Flags of countries, portraits of scenic views onto hardboard and a variety of other scenic settings can now be painted to create a one of a kind presentation with a three dimensional backdrop. Additionally, the hardboard artwork can be hung on walls in homes, walls of garages, and fences on backyards as just a few examples, to enhance the beauty of a setting. In contrast, it is worth nothing that the more common method of displaying, sports logos, teams, players, flags of countries, and portraits generally has been poster paper. The same images can uniquely be applied to a hardboard medium to present a unique style of decorative artwork for viewers to enjoy.

The present invention teaches a three dimensional medium made of wood for artwork. In a robust configuration, curved wood, which is more commonly known as a stave, is extracted from a wine barel, and used as the bare hardboard medium for a painting and a piece of artwork. This is in contrast to the more commonly used poster paper or canvas medium, and the hardboard provides an advantage to poster paper and canvas. The celestial spectacle of three dimensional wood which portrays an old and historic elegance can tie a room together neatly while also presenting a one of a kind display, less common than poster paper. With the hardboard medium, images such sports logos, flags, and portraits, can be painted but with the twist of the three dimensional appearance. As the staves are constructed with various stack up quantities depending on the user's requirements, the end result is a fascinating three-dimensional hardboard to be used as a medium for artwork. Oil and water colors can be used to paint the custom images with light and heavy brush strokes, rich and dark oils can also be applied directly onto the hardboard much like the Impressionists used to do in the 1800's.

Furthermore, the current invention presents a three dimensional medium for painting of custom artwork and can be designed by a consumer's preferences. Pieces of curved wood as described above, is taken from an empty wine barrel. The staves can be of different types including French oak, white oak, or American white oak. Once the staves are extracted from the wine barrel, they are stacked in a vertical configuration to create a medium back-drop for paintings by artists. Much like an artist that uses a canvas for the back drop of a painting, the constructed three-dimensional medium can be used as a back drop for a variety of custom artwork designs.

BRIEF DESCRIPTION OF THE DRAWINGS

FIG. 3 shows a configuration of a quantity of 8 staves assembled on top of each other. A quantity of 4 staves are configured with the staves bowed inward. A quantity of 4 staves are configured with the staves bowed outward.

FIG. 4 shows the configuration of FIG. 3 from a top view and the center gap between inwardly bowed staves and outwardly bowed staves is visible.

FIG. 5 shows the curved edges of the staves and the inward, outward bows of each stave as the medium is assembled with a quantity of 8 total staves.

FIG. 5 shows the back side of FIG. 2. In FIG. 6, a configuration of a quantity 8 staves are stacked up to create an assembly. A quantity of 4 staves are configured with the staves bowed inward. A quantity of 4 staves are configured with the staves bowed outward.

DETAILED DESCRIPTION OF THE DRAWINGS

Figure 1:
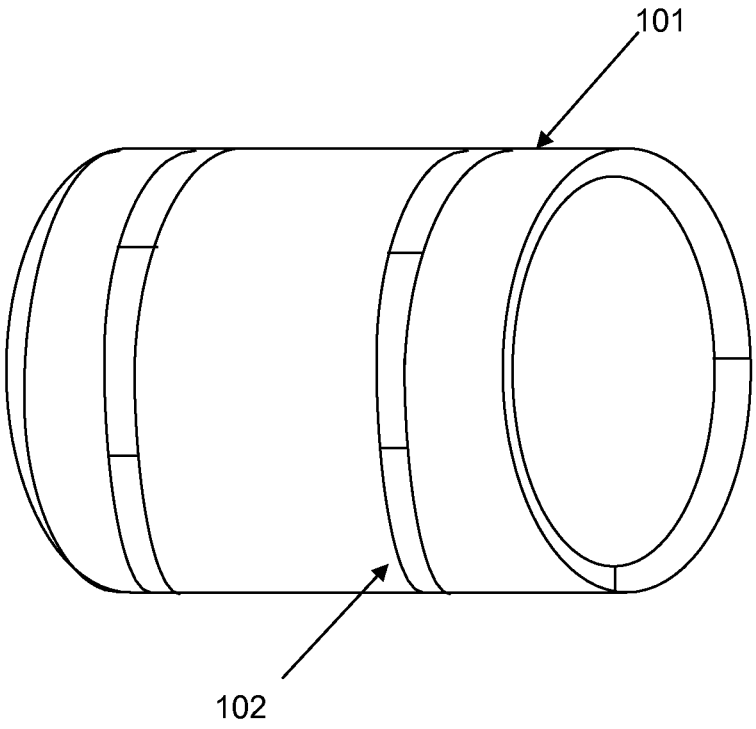
FIG. 1 is an illustration of an exterior view of a wine barrel in which wine is contained. The hardboard medium is constructed by extracting the staves from the wine barrel shown in FIG. 1.

While the present invention may be embodied in many different forms, designs or configurations, for the purpose of promoting an understanding of the principles of the invention, reference will be made to the embodiments illustrated in the drawings and specific language will be used to describe the same. It will nevertheless be understood that no limitation or restriction of the scope of the invention is thereby intended. Any alterations and further implementations of the principles of the invention as described herein are contemplated as would normally occur to one skilled in the art to which the invention relates.

FIG. 1 is an illustration of the entire wine barrel prior to disassembling and constructing hardboard mediums. The wine barrel 101 illustrated in FIG. 1 is a common illustration to present how wine is stored while various styles of oak are the type of wood typically used in constructing such wine barrels. In a standard wine barrel, 60 gallons of wine can be stored. This equates to almost a quantity of 1,800 glasses of wine. In addition, each barrel contains approximately 30 oak bowed pieces of wood.

After a duration of time, wine can no longer be stored in wine barrels as the barrels can no longer be sterilized. The oak can be extracted to be used for other purposes. Giving new life to old wine barrels can add valuable and ecological standpoints. In the past, old wine barrels have been transformed for useful purposes in households, stores, and manufacturing facilities. Using the old wine barrels is not uncommon, and the practice of reusing wine barrels can help save with expenses as well.

Some common practices for reusing wine barrels include: wine barrel dog houses for households with pets, manufacturing tables, chairs, and sinks are just a few more ways to reuse wine barrels. Taking the oak staves apart to be reused for the construction of hardboard back drops for artwork is another clever way to reuse the staves. The weight of a wine barrel can be up to 50 lbs, while each stave can weigh three lbs. The bowed shape of each stave is ideal for creating a three dimensional hardboard back drop for artistic work. On standard mediums, the layout of the canvas is flat. An artist can paint a three dimensional image on a flat back drop, however, the image can be enhanced by already having a three dimensional backdrop to paint upon. The staves provide a perfect foundation to create three dimensional backdrops.

Figure 2:
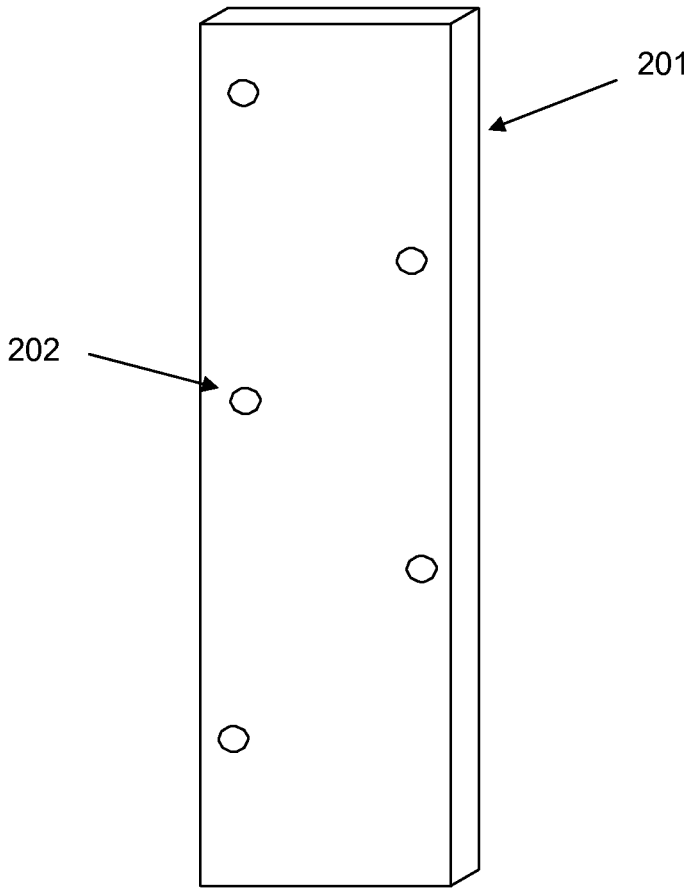
FIG. 2 is an illustration of the metal presented in a flat lay out. The metal is removed from the wine barrel and bent from the original position to become a flat piece of metal. It is then used as an item to assemble the staves and create the hardboard medium.

FIG. 2 shows is an illustration of the metal piece 201 presented in a flat position. It is to be acknowledged that each piece of metal is slightly bowed (not shown) less than 10 degrees. On the wine barrel, the metal piece 201, is bent in a position to form around the curvature of the wine barrel. Several pieces of the metal in FIG. 1 can be found screwed into the wood of the wine barrel. For securing the wine in a wine barrel, the metal pieces are arranged systematically around the outside of the wine barrel to help hold the staves and overall barrel structure together. For handling and transportation purposes, the ledges of the metal pieces can allow for support during physical movement as well. When disassembling the wine barrel, the curved metal pieces are removed individually and positioned on a flat bench for flattening. Once a wine barrel is taken apart, the remaining metal pieces can be preserved to create a plurality of hardboards for the backdrop of a painting.

FIG. 2 also has an illustration of several holes. These holes 202, are drilled through holes and can accommodate a variety of wood screws. In the most preferred embodiment, which is also the best mode of the invention, the holes are drilled out for a #3 sized wood screw with a minimum counter-bore size of a quarter inch. As will be discussed in the following drawings, flattening the metal is a crucial step in constructing the hardboard medium. Once the metal is flattened, the holes can be drilled through for clearance of a #3 wood screw. Depending on the size of the hardboard, there may as many as a quantity of 12 clearance holes drilled out to accommodate a large hardboard. In the most preferred embodiment, a total quantity of 6 holes is required to help assemble the hardboard back drop. When measuring the height of each metal piece, it is important to have the height of the stave stack up accounted for ahead of time. On custom designed images, each stave can be ordered to a desired height by the consumer. If a consumer intends to hang the hardboard artwork on a wall, the desired height of the hardboard may be measured to a those requirements. It is therefore, important to measure the height of the hardboard before measuring the height of the metal. As mentioned above, in the most preferred mode, a quantity of 8 clearance holes are required to be used upon a hardboard back drop height of approximately 36 inches. Therefore, the metal extracted from the wine barrel should be flattened and cut to a length of 12 inches and a height of 2 inches. In this configuration, a total of 6 holes can suitably be drilled through in a zig-zag formation as shown in FIG. 2. Each hole can accommodate one screw for one stave.

For the most preferred mode of the invention, a quantity of two metal pieces 201 are used on the back side of the hardboard medium. Each metal piece 201 is positioned at an equal distance apart from the center of the staves. By hand, the metal piece 201 is held up against the back side of the hardboard. A set of #3 wood screws are then drilled through the metal piece 201, and self tapped into the back side of the hardboard medium. Each wood screw can penetrate the backside of the hardboard medium to a length of approximately 0.5 inches. The thickness of each piece of metal 201 is approximately 0.25 inches thick. With this assembly structure, each bowed stave can securely be connected to the metal piece 201 for a robust construction.

Figure 3:
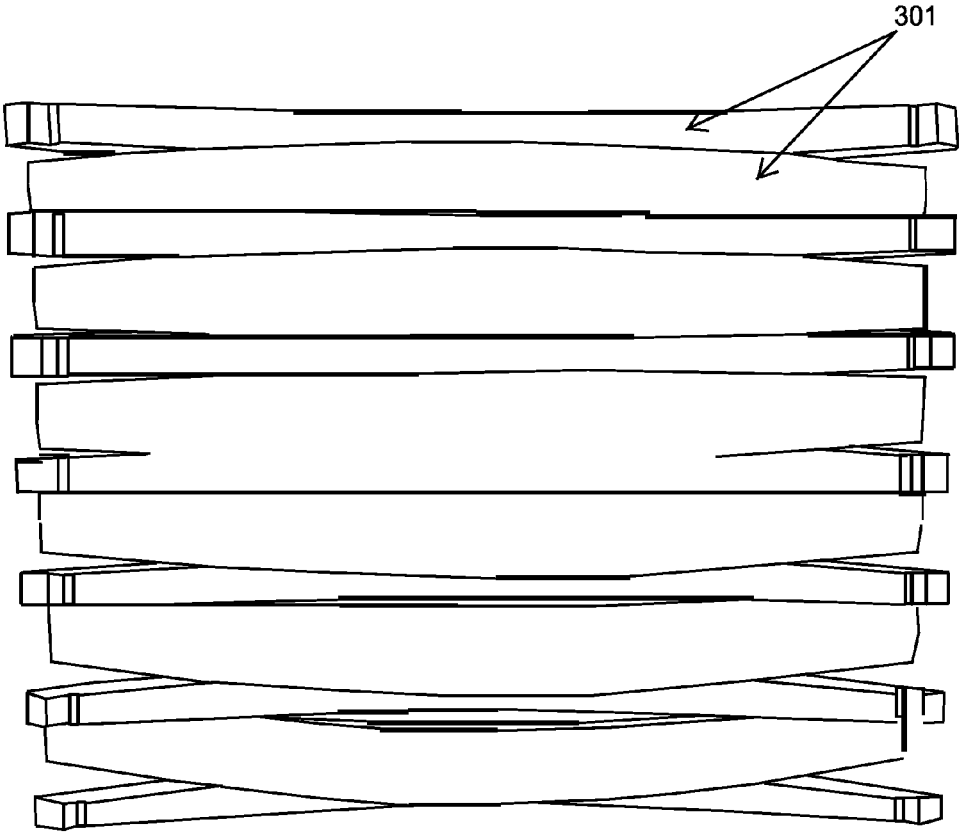
FIG. 3 is a front view illustration of a hardboard medium after a complete construction.

FIG. 3 is an illustration of one embodiment of the present invention. In this illustration, there are a total quantity of 13 staves stacked on top of each other to create a 13 board medium. The inside of a stave is what used to be the inside of a wine barrel. The outside of the stave is what used to be the outside of the wine barrel. In this configuration is to be acknowledged that the first member of the assembly is a bowed stave that can be identified as being "bowed inward". To begin the construction of the hardboard medium, the first stave rests on a work bench, floor, or any preferred area which is flat. Once a stave is extracted from the wine barrel, it may be wet from the wine, have a rough texture around the surfaces, and possibly require a cleansing before use. Each stave can also be smoothed over with sand paper on each surface and cleaned with anti-bacterial wipes before beginning construction. Each stave has a width of no less than 1.5 inches, a height of no less than 1 inch and no more than 4 inches, and length of no less than 34 inches and no more than 37 inches.

The first stave is set into place by laying one stave down on the ground with either the "bowed inward" side or "bowed outward" side facing up. Then the second stave is placed below the first stave, with the sides of stave one and two mating, but with opposite sides facing up. If the outside of the first stave is positioned as "bowed inward", then the second stave would be positioned as "bowed outward". This pattern of "bowed inward" staves stacked on top of "bowed outward" staves continues until the desired height is reached.

Once the desired height is reached, the metal pieces as described in FIG. 2, can be taken and applied to the back side of the hardboard medium. This section of the assembly may require two helpers assisting one another for alignment purposes. One person may hold the stack up of staves in place, while the other person can move around to the back side of the hardboard to press the metal piece against the hardboard. Assuming the metal pieces are already drilled through with holes, the wood screws can be drilled through the metal and into the wood approximately 0.5 inches deep, as described in FIG. 2. Both helpers play in integral part in the assembly process at this step. The first helper must keep the staves in place and prevent the structure from moving while the second helper works to align the metal to the back side and drill wood screws into the staves. The process can also be performed by one worker when the structure of the hardboard is not exceeding 12 staves. It is preferred however, to have a second helper for guidance and support during this step of construction when the height of the hardboard medium is higher than 40 inches or more than 12 staves.

Once the structure is robust with the wood screws drilled into the wood structure, the process of painting can begin. Paint used on the wood staves can include various types such as oil paint, water color, or spray paint. The areas of the staves where paint can be applied are the front bowed surfaces shown in 301. Although only two surfaces are indicated in FIG. 3 with identifiers, it is to be noted that all remaining front surfaces of the staves may be painted. On these surfaces, the paint can be portrayed in a three dimensional display. It is important to note that applying sand paper to the painted surfaces prior to the application of paint can help with smoothing the surfaces of the staves. The sand can also help remove surface shine on the wood for a more appealing display of artwork. Once the hardboard medium is constructed and the types of paint are selected, a variety of custom images and logos can be painted or spray painted onto one surface of the medium.

Figure 4:
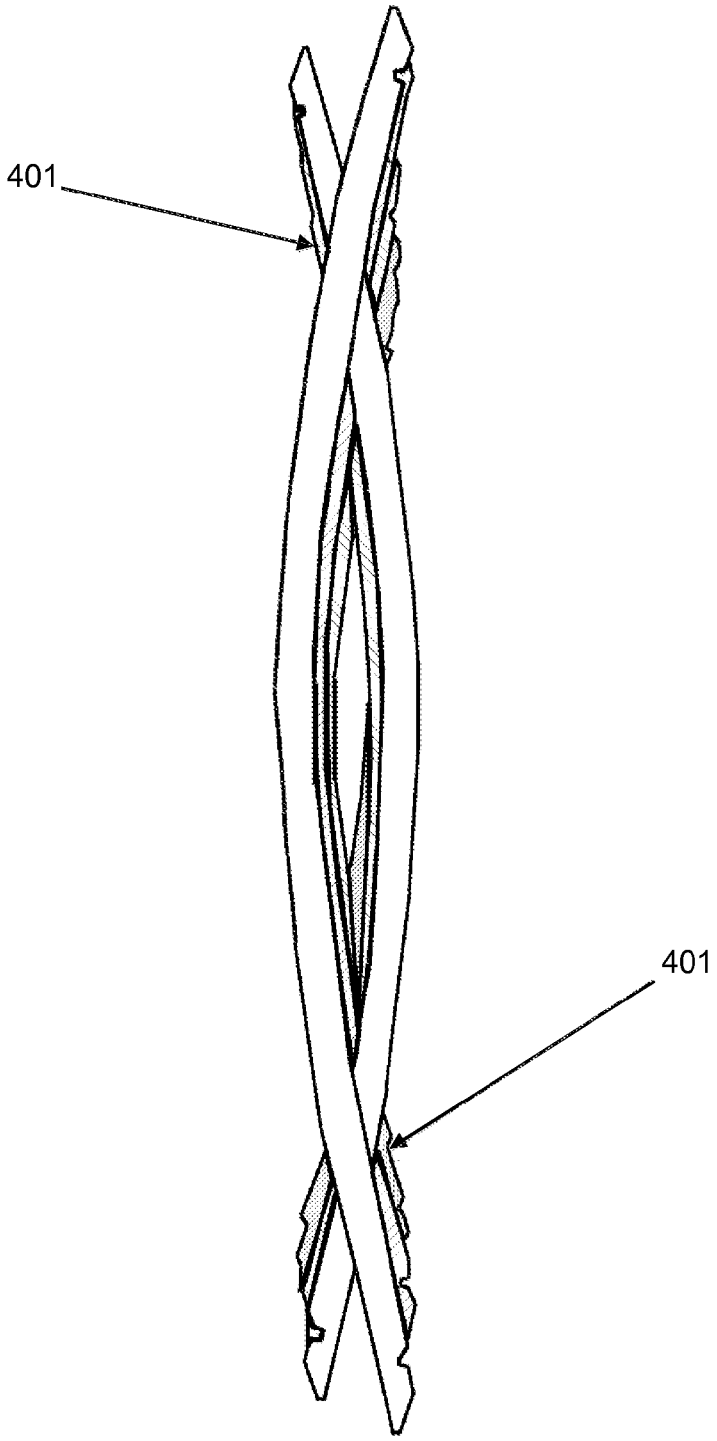
FIG. 4 is an illustration of the top view of a hardboard medium for artistic painting.

FIG. 4 is a top view illustration of the hardboard medium. In this illustration the stack up structure of the hardboard can be viewed to obtain a clear understand of the construction of the hardboard medium. The angle of each stave is displayed which in turn forms the gap inside the middle of stack up structure. On the intersection points 401, where the stacks of staves meet, it is extremely critical for the alignment of the structure. At these points, the metal piece from FIG. 2 is also positioned and drilled through with wood screws to connect the staves. When all the staves are stacked up and positioned to the desired height, the appropriate length of metal can be sawed and placed in the intersection point 401.

The gap in between the staves can also be used a type of holder for various sizes of wine bottles as an example. A variety of round objects that may appear to fit inside the gap can be placed for decorative purposes in a home as well. A popular area to hang the artwork can be on the walls of homes, garages of homes, and on the fences of backyards just to name a few examples. If the consumer wishes to hang the artwork on the fence of a backyard, the gap in between the staves can be used to place solar light fixtures as well. The solar light can illuminate the artwork on the staves during evening hours and present a unique display of the three dimensional artwork for viewers.

Figure 5:
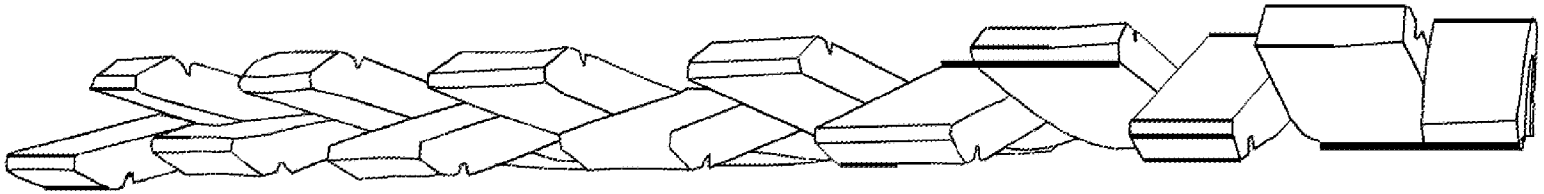
FIG. 5 is an illustration of the side view of a hardboard medium for artistic painting.

FIG. 5 is an illustration of the hardboard medium for artwork presented from a side angle. In this side perspective view, each stave can be viewed in more detail. Each stave is stacked on top of one another as described in FIG. 3, and while this image represents a stack up of a quantity of 12 staves; the hardboard medium can be constructed with as few as 3 staves, or as many as the user desires. It is important to note from the description in FIG. 1 that each stave can weigh 3 lbs. When constructing the hardboard medium, transportation should be considered as a design with 12 or more staves can weight over 40 lbs. In FIG. 5, the weight of the hardboard medium is approximately 40 lbs. The three dimensional effect of artwork displayed onto hardboard medium is enhanced by the bow of each stave. Each stave is bowed at approximately 10 degrees, and thus allowing the viewer to further appreciate the unique quality of the art. Sports team logos, flags of countries, and images of nature are a few custom art ideas that may be applied to the hardboard medium. Each style of artwork can be painted on the entire surface of the hardboard medium. The "inward bowed" staves exemplify a view of distance from the planar surface, while the "outward "bowed" staves create a view as if the painting is approaching the viewer. It is the combination of inward and outward bows stacked on top of one another which further intensifies the three-dimensional artistic presentation. While oil paint and water colors are the preferred method of applying paint to the hardboard medium, spray paint can also portray a particular presentation which appeals to viewers as well.

Figure 6:
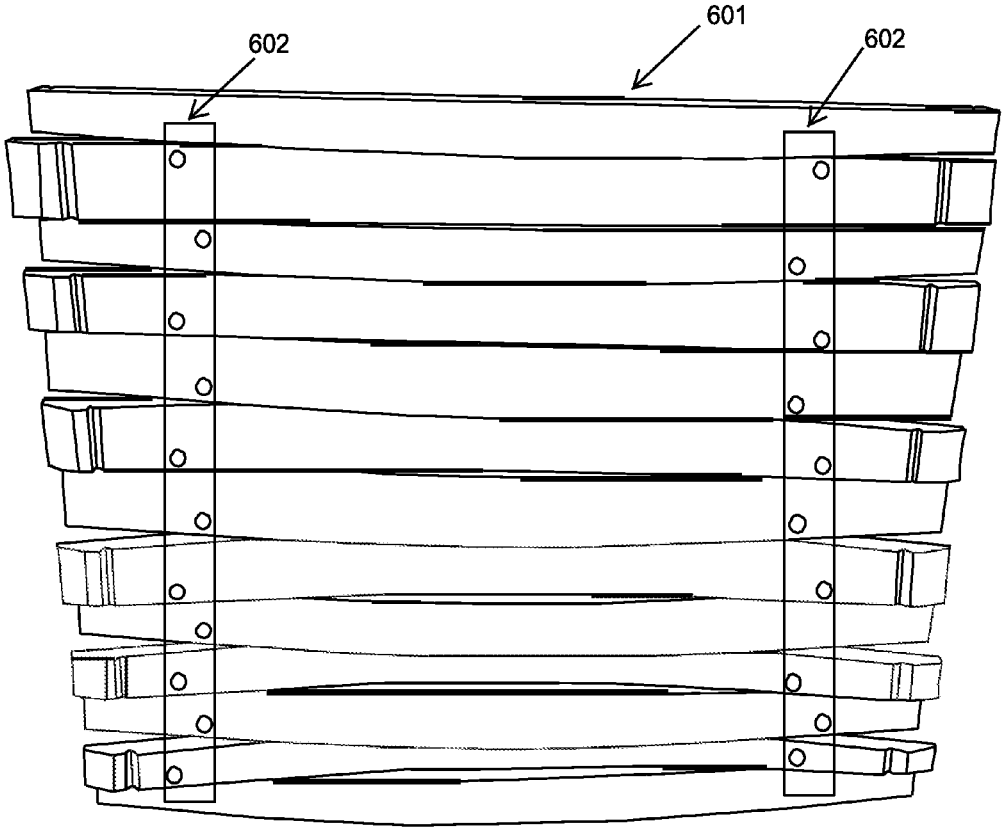
FIG. 6 is an illustration of the back view of a hardboard medium for artistic painting.

FIG. 6 is an illustration of the same embodiment as FIG. 3 of the hardboard medium. However, FIG. 6 illustrates the rear view of hardboard medium 601. Again, the hardboard medium 601 is constructed with a quantity of 13 staves. The total weight of the hardboard medium in FIG. 6 is approximately 40 lbs. This type of design may be challenging to transport and again, two helpers may be required to place the hardboard medium in a desired location. As mentioned above, the most preferred embodiment for construction of the hardboard medium is by using a total quantity of 6 staves. With 6 staves stack up, a length of metal 602 as described in the FIG. 6 should be cut to approximately a length of 12 inches. Once each stave is prepared and stacked up, each hole in the metal piece 602 must be drilled into each individual stave to connect all staves together. By using a 12 inch length piece of metal 602, made of aluminum alloys, the viewer looking directly at the front of the hardboard medium, is restricted from seeing the components on the rear side of the hardboard medium. Each piece of metal 602, is slightly bowed (not shown), as also described in previous figures. This bowed feature allows for more surface contact and a stronger mate between the bowed staves. Drilling wood screws into each metal piece 602, and penetrating into the staves is the final step of construction of the hardboard medium to allow for a robust design.

In the embodiment presented in FIG. 6, the metal piece 602 must be cut into a length of approximately 24 inches. When constructing a hardboard medium which includes 13 staves, a thicker piece of metal 602 can be used to provide strength for the structure. In turn, larger wood screws can be used to accommodate the thickness of the metal as well. By using larger wood screws, drilling through the clearance holes in the metal 602 and an extra 0.5 inch into the staves will provide a brawny construction for the hardboard medium.

The following invention provides many advantages for creative artists to apply a new style of decorative artwork. With the three dimensional design, an appealing style of art is presented to viewers of all generations. As mentioned above, the millenial generation, particularly those who are sports fans, can further benefit from a three dimensional style of hardboard medium. Custom team logos can be painted, or spray painted onto the hardboard medium with a variety of colors to create a personal touch to each team logo. As another example, those with a passion and pride of their heritage can express their native country flag logos onto the hardboard mediums and display the artwork in and around their homes, and gardens. Consumer of other ages can additionally benefit from the three dimensional hardboard mediums for artwork. For example, the retired community, who enjoys leisurely activities such as painting and drawing can use the present invention to create their own custom art of scenery, nature, and any other type of artwork that is desired. The custom logos styles are endless, and any type of art that the imagination desires can be painted or spray painted onto the constructed hardboard medium. Perhaps even applying the Impressionist style of artwork with shorter brush strokes can magnify the Impressionist style when incorporated with the three dimensional hardboard medium.

Although one or more embodiments of the three dimensional invention have been described in detail, one of ordinary skill in the art will appreciate the modifications to the material selection, design of the three dimensional hardboard medium for custom artwork design. It is acknowledged that obvious modifications will ensue to a person skilled in the art. The claims which follow will set out the full scope of the invention.

The invention claimed is:

1. A medium hardboard for creating artwork comprising:

a plurality of bowed staves beginning with one bowed stave placed on a flat surface with either the inside or outside of the stave facing up, a second bowed stave placed below said first bowed stave with the sides of said bowed stave one and said bowed stave two mating, and with opposite sides facing up, when outside of said bowed stave one is facing up, said second bowed stave shows the inside of said bowed second stave, a pattern of stave direction is repeated until desired stack up;

two metal strips, a first metal strip placed on rear side of said stack up, a second metal strip placed on said rear side of said stack up at an equal distance from said first metal strip and the center of said stack up, said metal strips having a plurality of through holes, a first through hole on the top left corner of said metal strips, a second through hole below said first through hole on the opposite side of said first through hole and approximately one inch below said first through hole;

a pattern of hole position continues until the desired number of through holes are reached; and a plurality of screws to drill into said through holes of said metal strips to penetrate into said bowed staves to attach said metal strips to said bowed staves, to complete construction of said hardboard medium.

2. The hardboard medium of claim 1, further comprising an image displayed on one side of said bowed staves.

3. The hardboard medium of claim 2, wherein said image is spray painted onto said bowed staves.

4. The hardboard medium of claim 1, further comprising an image displayed on said bowed staves.

5. The hardboard medium of claim 4, wherein said custom image is brush painted onto said bowed staves.

6. The hardboard medium of claim 1, wherein said pattern of bowed staves stacked up is no less than three staves.

7. The hardboard medium of claim 1, wherein said bowed staves are made of pine wood.

8. The hardboard medium of claim 1, wherein said metal strips are made of aluminum alloys.

9. The hardboard medium of claim 1, where said metal strips are in the shape of a rectangle.

* * * * *